US007055487B2

(12) United States Patent
Kawakubo et al.

(10) Patent No.: US 7,055,487 B2
(45) Date of Patent: Jun. 6, 2006

(54) VEHICLE ENGINE

(75) Inventors: Hiroyuki Kawakubo, Saitama (JP); Toru Gunji, Saitama (JP); Hiroshi Nakagome, Saitama (JP); Toshihisa Nagashii, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 276 days.

(21) Appl. No.: 10/757,529

(22) Filed: Jan. 15, 2004

(65) Prior Publication Data

US 2004/0200658 A1 Oct. 14, 2004

(30) Foreign Application Priority Data

Jan. 21, 2003 (JP) ..... 2003-012103

(51) Int. Cl.
*F01M 1/00* (2006.01)

(52) U.S. Cl. ..... 123/196 A; 123/195 R; 123/198 R

(58) Field of Classification Search ..... 123/196 R, 123/196 A, 195 R, 198 R
See application file for complete search history.

(56) References Cited

U.S. PATENT DOCUMENTS 4,616,610 A 10/1986 Ishida
6,470,847 B1 10/2002 Kawamoto

FOREIGN PATENT DOCUMENTS

JP 2705777 B2 10/1997

OTHER PUBLICATIONS

Motociclismo, Dec. 31, 2001, p. 287, Italy.
Motociclismo, Apr. 30, 2002, p. 254, 263, 193.

*Primary Examiner*—Noah P. Kamen
(74) *Attorney, Agent, or Firm*—Birch, Stewart, Kolasch&Birch, LLP

(57) ABSTRACT

To facilitate attachment/detachment work of an oil filter in a vehicle engine without increasing an outer dimension thereof, and to provide a uniform a supply of engine oil into an engine body. An oil filter is attached onto a front portion of the engine body so as to be detachable in a vehicle body width direction from a side face of the engine body. An exhaust pipe on a side on which an oil filter is attached is displaced to a center side in the vehicle body width direction so as not to overlap the oil filter when viewed from a front of the engine body.

18 Claims, 7 Drawing Sheets

VEHICLE ENGINE

CROSS-REFERENCE TO RELATED APPLICATIONS

The present application claims priority under 35 USC 119 to Japanese Patent Application No. 2003-012103 filed on Jan. 21, 2003 the entire contents thereof is hereby incorporated by reference.

BACKGROUND OF THE INVENTION

1. Field of the Invention

The present invention relates to an arrangement of an oil filter for engine oil and an oil passage in a vehicle engine. More particularly to an arrangement for providing an ease of maintenance.

2. Description of Background Art

Conventionally, in a vehicle engine provided with exhaust pipes which are curved downwardly from a front wall of a cylinder body, pass in front of and below a crankcase, and extend rearwardly of an engine body, a cartridge type oil filter is available that is attached between a vertically extending portion of one of the exhaust pipes and a front wall of the crankcase so as to be detachable in a vehicle body width direction from a side end side of the engine body. See, for example, Publication of Japanese Patent No. 2705777. Thus, obstructions with respect to the attachment/detachment direction of the oil filter are removed to enhance an ease of maintenance. In addition, front and back portions of the oil filter can be protected by the exhaust pipe and the crankcase.

The attachment/detachment of the cartridge type oil filter usually requires a rotation of the oil filter. Accordingly, it is necessary to rotate the oil filter itself by utilizing a tool or an individual's hand.

However, in the conventional vehicle engine described above, the exhaust pipes and the crankcase are arranged in front of and to the rear of the oil filter. Accordingly, it is difficult to position the tool or the individual's hand onto the oil filter. In addition, it is difficult to perform the rotation of the oil filter. Moreover, widening a gap between the exhaust pipes and the crankcase for the purpose of ensuring a working space increases an outer dimension of the engine and lowers a degree of freedom in vehicle body layout. Therefore, it is not preferable.

SUMMARY AND OBJECTS OF THE INVENTION

This invention has been created in consideration of the foregoing circumstances. It is an object of the invention to facilitate attachment/detachment work of an oil filter in a vehicle engine without increasing an outer dimension thereof, and to provide a uniform supply of engine oil into an engine body.

As a means for solving the problems described above, the present invention provides a vehicle engine including a plurality of exhaust pipes 44 which are curved downwardly from a front wall 45 of a cylinder body 40, pass in front of and below a crankcase 41 and extend rearwardly of an engine body 15. An oil filter 134 is attached onto a front portion of the engine body to be detachable in a vehicle body width direction from a side face of the engine body. The exhaust pipe on a side on which the oil filter is attached is displaced to a center side in the vehicle body width direction so as not to overlap the oil filter when viewed from a front of the engine body.

According to the vehicle engine, the exhaust pipe on the side on which the oil filter is attached is displaced to the center side in the vehicle body width direction so as not to overlap the oil filter when viewed from the front of the engine body. Thus, when the oil filter is attached/detached in the vehicle body width direction, the oil filter can be tightened or loosened by placing a tool or a hand thereon from the front of the engine body. Thus, an increase in an outer dimension thereof from the front of the engine body and an increase in an outer dimension of the engine can be restrained.

According to the present invention the vehicle engine provides an oil cooling device 97 that is provided on the front portion of the engine body, engine oil having passed through the oil filter is introduced into the oil cooling device. The engine oil having passed through the oil cooling device is introduced into an approximate central portion of a main oil gallery 73 in the vehicle body width direction. The main oil gallery 73 is arranged in the cross crankcase vicinities of both ends of a crankshaft 60.

According to this vehicle engine, the oil cooling device is provided on the front portion of the engine body, thus making it possible to enhance an air-cooling effect of air passing over the engine body. Moreover, the engine oil is introduced from the oil cooling device into the approximate center portion of the main oil gallery in the vehicle body width direction. Accordingly, oil pressure in the main oil gallery can be made uniform in the vehicle body width direction. Furthermore, the engine oil can be supplied into the engine body after passing through the oil filter and the oil cooling device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention is described below based on the drawings.

Figure 1:
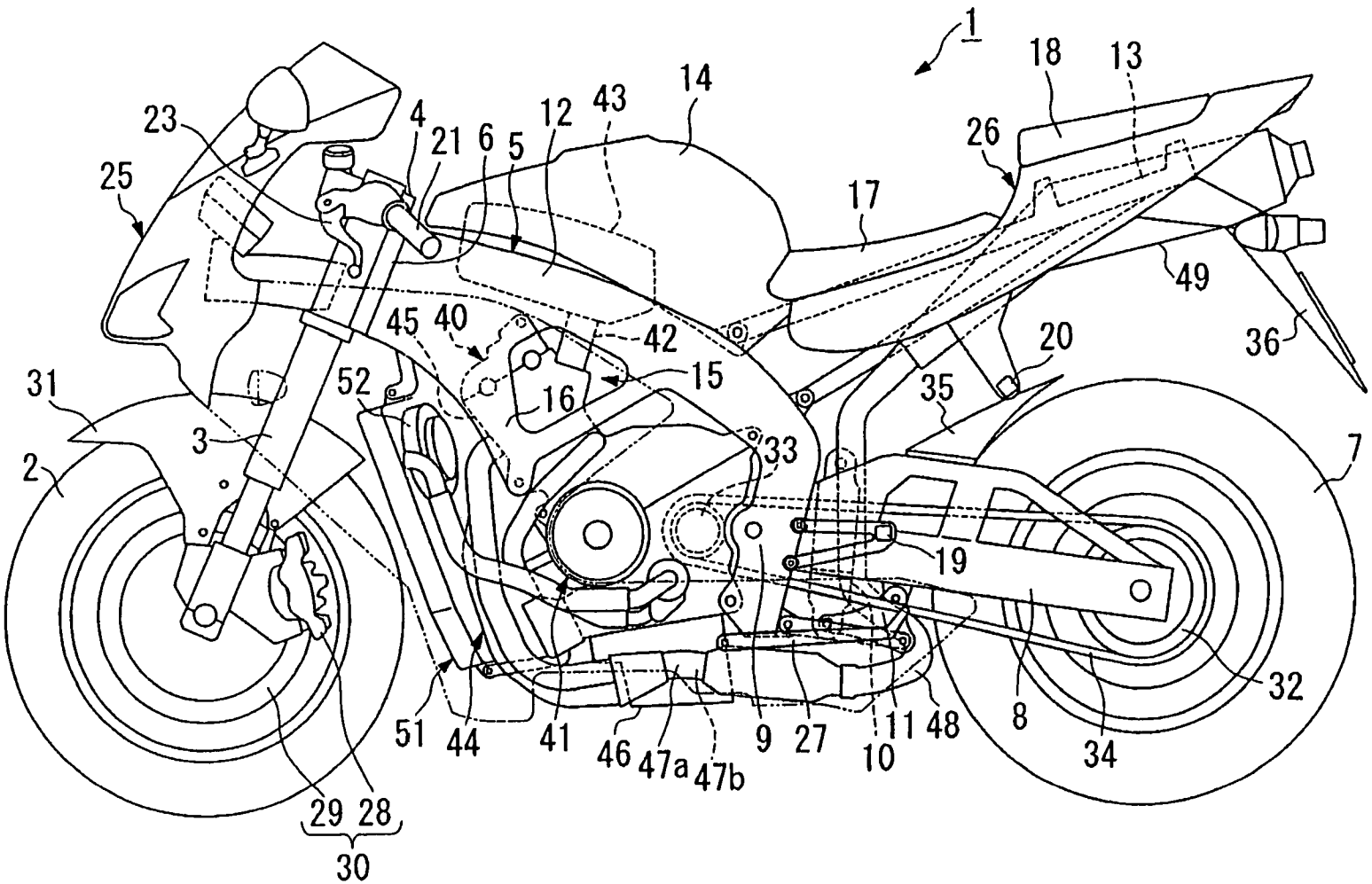
FIG. 1 is a side view of a motorcycle in an embodiment of the invention.

As shown in FIG. 1, a front fork 3 rotatably supports a front wheel 2 of a motorcycle 1 and is pivotally supported in a head pipe 6 provided on a front end portion of a body frame 5 by interposing a steering stem 4 therebetween so as to be steerable. A rear fork 8 rotatably supports a rear wheel 7 and is pivotally supported by a pivot unit 9 provided in an intermediate portion of the body frame 5 so as to be swingable. A rear cushion 10 is coupled to the vicinity of a swing center of the rear fork 8 by interposing a link unit 11 therebetween.

From an upper portion of the head pipe 6, a main frame 12 of the body frame 5 is branched in right and left directions to extend to a lower rear side, and rear end portions thereof are bent downwardly to be linked to the pivot unit 9. A seat frame 13 of the body frame 5 is coupled to a rear portion of the main frame 12. A fuel tank 14 is arranged on the main frame 12, and an engine body 15 of a water-cooled in-line four-cylinder engine according to the present invention is arranged under the main frame 12. An engine hanger 16 extends downwardly from a lower portion of the head pipe 6. The engine body 15 is supported by the engine hanger 16, main frame 12 and pivot unit 9, and the like.

To the rear of the fuel tank 14, a seat 17 for a rider and a pillion seat 18 for a passenger are supported individually by the seat frame 13. Moreover, steps 19 for a rider are attached to the rear of the pivot unit 9 of the body frame 5. In addition, steps 20 for a passenger are attached to a lower portion of the seat frame 13. Furthermore, a pair of left and right handles 21 and 22 are attached onto an upper end portion of the front fork 3. A clutch lever 23 is arranged in front of the left-side handle 21, and a brake lever 24 is arranged in front of the right-side handle 22.

A front body portion of the motorcycle 1 is covered with a front cowling 25, and a periphery of the seat frame 13 is covered with a rear cowling 26. Moreover, a retractable side stand 27 is arranged on a lower left side of the body frame 5, and a body of the motorcycle 1 is supported by this side stand 27 in an erected state being inclined to the left side.

A front brake device 30 includes a brake caliper 28 that is attached onto a lower end portion of the front fork 3. A brake rotor 29 corresponding to the brake caliper 28 is attached onto the front wheel 2. In addition, a front fender 31 which covers an upper portion of the front wheel 2 is attached onto the lower end portion of the front fork 3.

A rear sprocket 32 is attached onto a left side of the rear wheel 7, and a drive chain 34 is looped around this rear sprocket 32 with a drive sprocket 33 arranged on a left rear side of the engine body 15. Thus, it is possible to transmit a drive force from the engine body 15 to the rear wheel 7. A front-side rear fender 35 covers an upper front side of the rear wheel 7 and is attached above the rear fork 8. A rear fender 36 covers an upper rear side of the rear wheel 7 and is attached onto a lower portion of the rear cowling 26. Note that a rear brake device (not shown) has a similar configuration to that of the front brake device 30 of the front wheel 2 and is provided on a right side of the rear wheel 7.

A cylinder body 40 of the engine body 15 is arranged on a crankcase 41 in a state of being slightly leaning forward. Throttle bodies 42 corresponding to the respective cylinders are connected to a rear portion of the cylinder body 40, and the respective throttle bodies 42 are connected to an air cleaner case 43 arranged between the main frame 12 and the fuel tank 14. Moreover, exhaust pipes 44 corresponding to the respective cylinders are connected to a front portion of the cylinder body 40. The exhaust pipes 44 extend forward from a front wall 45 of the cylinder body 40, and then are curved downwardly. Then, the exhaust pipes 44 pass in front of and below the crankcase 41, and extend rearwardly of the engine body 15.

Figure 2:
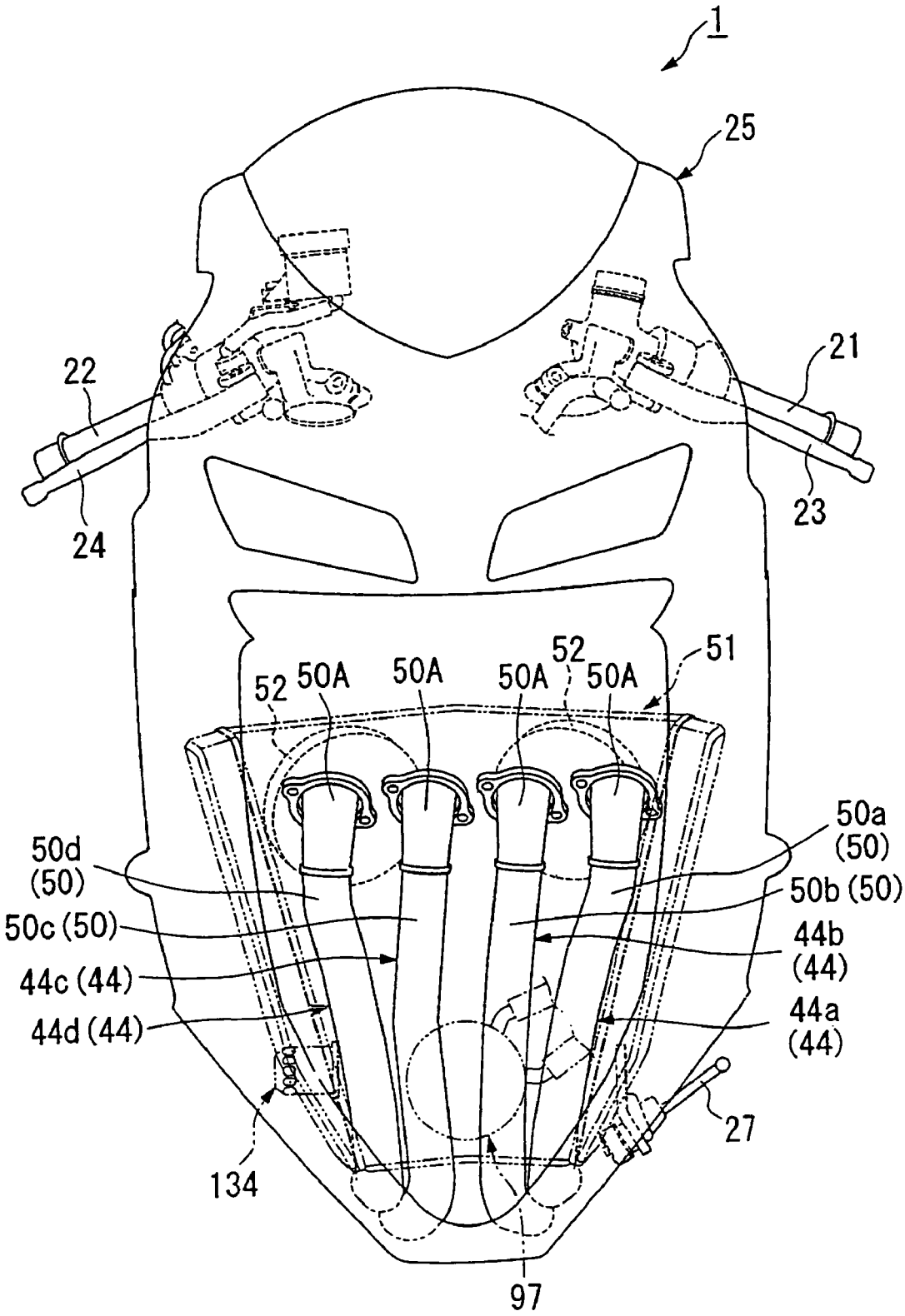
FIG. 2 is a front view of the motorcycle.

More specifically, the exhaust pipes 44 extend forward from the front wall 45 of the cylinder body 40, and are soon bent downwardly. Then, the exhaust pipes 44 extend downwardly while passing in front of the cylinder body 40 and the crankcase 41, and then are further bent rearwardly, thus being arranged below the crankcase 41. Referring to FIG. 2 in combination, the four exhaust pipes 44 are denoted, from the right side, by reference numerals 44*a*, 44*b*, 44*c* and 44*d*. Then, the exhaust pipes 44*a* and 44*b* arranged below the crankcase 41 extend rearwardly while avoiding, to the right side, an oil pan 46 which bulges downward from a lower portion of the crankcase 41, and are collected into one piece, thus being formed into a secondary exhaust pipe 47*a*. In a similar way, the exhaust pipes 44*c* and 44*d* extend rearwardly while avoiding the oil pan 46 to the left side, and are collected into one piece, thus being formed into a secondary exhaust pipe 47*b*.

Then, to the rear of the oil pan 46, the respective secondary exhaust pipes 47*a* and 47*b* are collected to be one collective pipe 48. The collective pipe is bent upwardly to the rear of the pivot unit 9, extends upwardly, and then, is further bent rearwardly in the vicinity of the seat frame 13. A silencer 49 is supported on the seat frame 13, and a rear end portion of the collective pipe 48 is connected to the silencer 49. Bent portions 50A on a connection end side of the exhaust pipes 44 to the cylinder body 40 and downwardly extending portions 50 extending downwardly from the bent portions 50A are configured separately from each other. The bent portions 50A and the downwardly extending portions 50 are joined together by laser welding and the like so as to be integrated.

The downwardly extending portions 50*a*, 50*b*, 50*c* and 50*d* correspond to the respective exhaust pipes 44*a*, 44*b*, 44*c* and 44*d*. Then, the downwardly extending portions 50*a* and 50*d* of the exhaust pipes 44*a* and 44*d* are bent such that lower portions thereof are displaced to an inside in a vehicle body width direction more than the upper portions thereof. Moreover, below the crankcase 41, the exhaust pipes 44*a* and 44*b* are arranged so as to be brought into contact with the exhaust pipes 44*b* and 44*c* on the insides thereof, respectively, and extend rearwardly. Furthermore, the exhaust pipes 44*a* and 44*d* on the outsides in the vehicle body width direction are located higher than the exhaust pipes 44*b* and 44*c* on the insides thereof. Thus, a banking angle of the vehicle body and an adequate space in the vicinities of an operator's feet are ensured.

In front of the exhaust pipes 44, a radiator 51 is arranged in an attitude of being slightly leaning forward in a similar way to the cylinder body 40. The radiator 51 is formed into a round type in which a front face side thereof is curved into a concave shape. The radiator 51 is provided so as to extend from an upper portion of the cylinder body 40 to the lower portion of the crankcase 41 in a vertical direction. A right and left pair of radiator fans 52 are attached onto a back face upper side of the radiator 51. Moreover, in relation to ensuring the banking angle of the vehicle body and an adequate space in the vicinities of an operator's feet, the radiator 51 is gradually narrowed downwardly in the vehicle body width direction.

Figure 3:
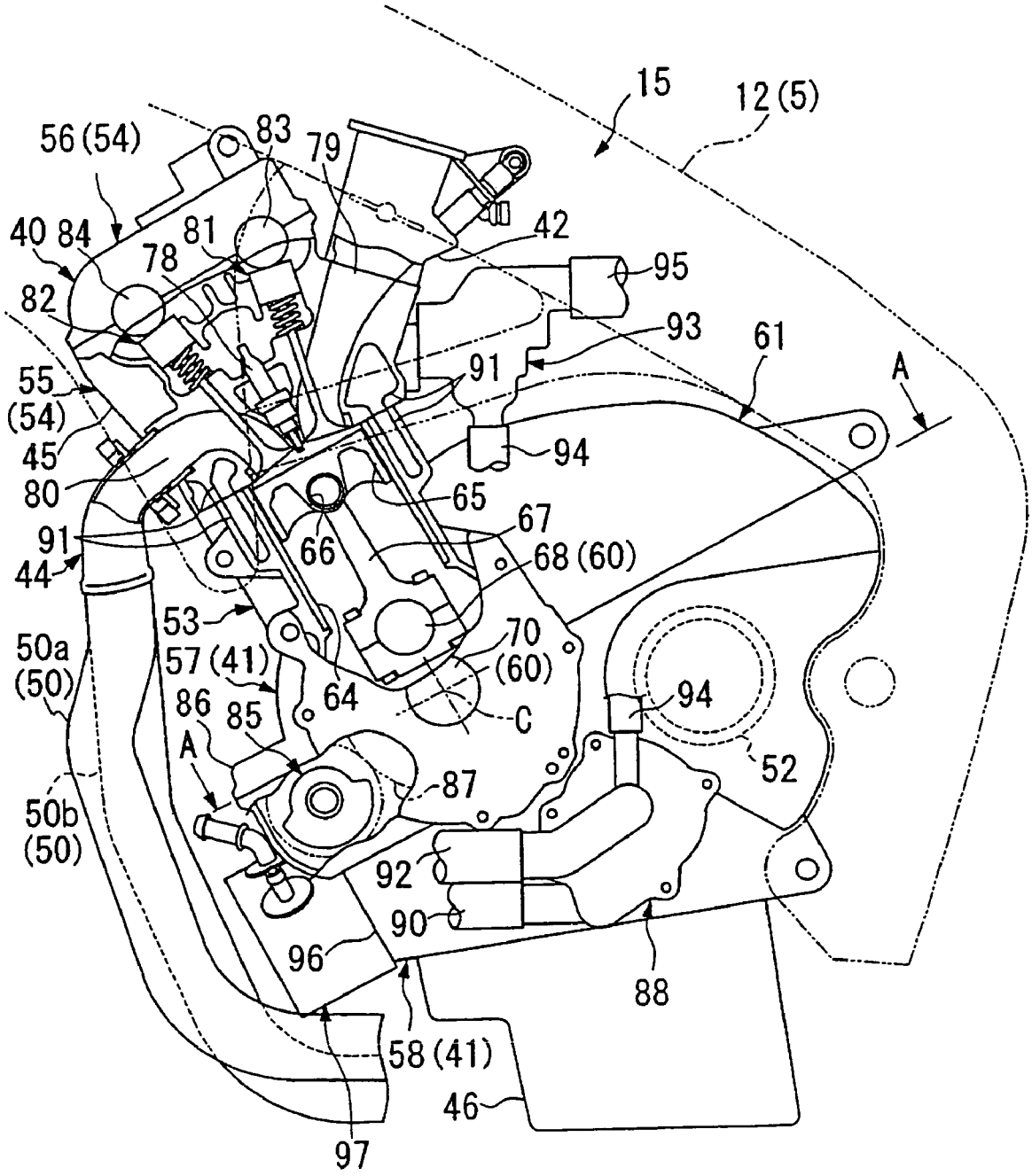
FIG. 3 is a side view of a periphery of an engine body in FIG. 1.

As shown in FIG. 3, the engine body 15 includes a cylinder block 53 and a cylinder head 54, which are main parts of the cylinder body 40, and the crankcase 41. The cylinder head 54 is configured separately of a head body 55 and a head cover 56, and the crankcase 41 is configured separately of an upper case 57 and a lower case 58. The upper case 57 and the cylinder block 53 are integrally formed, and the oil pan 46 is attached under the lower case 58.

Figure 4:
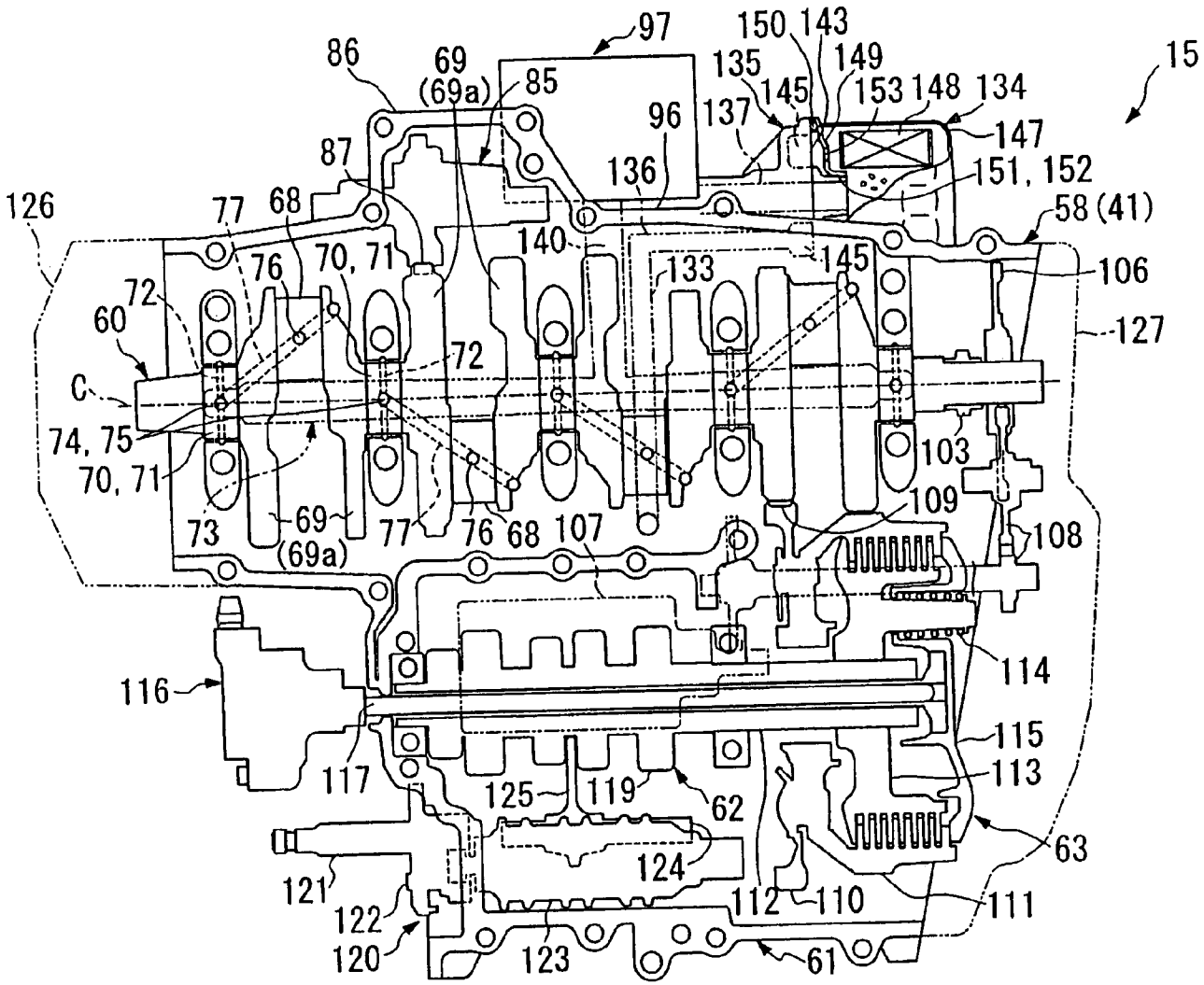
FIG. 4 is a cross-sectional view along a line A—A in FIG. 3.

Referring to FIG. 4 in combination, a crankshaft 60 having an axial line C parallel to the vehicle body width direction is arranged in the crankcase 41.

Moreover, a transmission case 61 is connected to the rear portion of the crankcase 41. Within the transmission case 61, a transmission 62 and a clutch mechanism 63 are arranged individually. Four cylinders 64 are formed in the cylinder block 53 so as to be arrayed in the vehicle body width direction, and pistons 65 are slidably fitted into the cylinders 64.

To each of the pistons 65, a connecting rod 67 is coupled by interposing a piston pin 66 therebetween so as to be freely rotatable, and a large end portion of the connecting rod 67 is coupled to a crank pin 68 of the crankshaft 60 so as to be freely rotatable. Each of the crank pins 68 is supported by a pair of crank arms 69, and a counter weight 69*a* is integrally formed on a region of each of the crank arms 69, which is on an opposite side to the crank pin 68. Five journal portions 70, provided on the axial line C between both end portions of the crankshaft 60 and among the respective crank arms 69, are supported on bearings 71 provided in the upper case 57 and the lower case 58 so as to be freely rotatable. Reciprocating motions of the pistons 65 are converted into rotational motions with the axial line C taken as a center.

Here, an oil groove 72 is formed on an approximate center in a direction of the axial line C on a receiving surface of each of the bearings 71, which supports a peripheral surface of the journal portion 93. Moreover, in a lower portion of the crankshaft 60 in the lower case 58, a main oil gallery 73 is formed that extends in the vehicle body width direction across the vicinities of both ends of the crankshaft 60. The main oil gallery 73 and the oil groove 72 of each of the bearings 71 are made to communicate with each other by an oil passage 74, and engine oil is supplied to each of the bearings 71 from the main oil gallery 73 through this oil passage 74 and the oil groove 72.

Moreover, in four journal portions 70 excluding the one on the far right side, oil holes 75 penetrating regions of the bearings 71 in a diameter direction thereof are formed, the regions corresponding to the oil grooves 72. In a similar way, in the crank pins 68, oil holes 76 penetrating, in a diameter direction, approximate center portions thereof in an axial direction are formed. Approximate center portions of the oil holes 75 in the diameter direction of the journal portions 70 and approximate center portions of the oil holes 76 in a diameter direction of the crank pins 68 are made to communicate with each other through communication oil holes 77 drilled diagonally with respect to the axial line C from side portions of right-side crank arms 69 supporting the respective crank pins 68. A part of the engine oil supplied to the oil grooves 72 is supplied to peripheral surfaces of the respective crank pins 68 through the oil holes 75, the communication oil holes 77 and the oil holes 76. Note that openings of the communication oil holes 77 formed in the crank arms 69 are closed by forcibly inserting steel balls and the like therein.

On the cylinder head 54, ignition plugs 78 are mounted so as to face to the insides of respective combustion chambers. Intake manifolds 79 and exhaust manifolds 80, which communicate the respective combustion chambers with the outside, are formed individually. The throttle bodies 42 are connected to outside openings of the respective intake manifolds 79, and the exhaust pipes 44 are connected to outside openings of the respective exhaust manifolds 80. Moreover, on intake ports that are combustion chamber side openings of the respective intake manifolds 79, intake valves 81 which open/close the intake ports are provided, and on exhaust ports that are combustion chamber side openings of the respective exhaust manifolds 80, exhaust valves 82 which open/close the exhaust ports are provided. Above the respective intake valves 81 and exhaust valves 82, intake side camshafts 83 and exhaust side camshafts 84, which operate these valves, are arranged. The respective camshafts 83 and 84 are made hollow, and the engine oil flows through such hollow portions, and then is supplied from the oil holes and the like to respective sliding surfaces.

On a region slightly on a left side of the vehicle body width direction, the region being a front portion of the crankcase 41, a secondary balancer 85 is arranged. This secondary balancer 85 is accommodated in an accommodation portion 86 formed by partially bulging the upper case 57 and the lower case 58 in a forward direction. A balancer drive gear 87 which rotationally drives the secondary balancer 85 is provided on outer peripheral portions of the left side crank arm 69 supporting the second crank pin 68 from the left side and of the counter weight 69*a* formed integrally with the crank arm 69.

A water pump 88 is arranged on a left side of the lower case 58. This water pump 88 is arranged coaxially with an oil pump 89 (refer to FIG. 5) to be described later in the vehicle body width direction, and operates together with the oil pump 89 accompanied with rotation of the crankshaft 60. To this water pump 88, a radiator outlet hose 90 communicating with an outlet-side tank of the radiator 51 and a cooling water introduction hose 92 communicating with a water jacket 91 for the cylinder head 54 and the cylinder block 53 are connected (refer to FIG. 1). Moreover, a thermostat 93 is connected to the rear portion of the cylinder head 54, and a bypass hose 94 is arranged between the thermostat 93 and the water pump 88. A radiator inlet hose 95 communicating with an inlet-side tank of the radiator 51 is connected to a cooling water extraction port of the thermostat 93.

When the water pump 88 is operated, the cooling water extracted from the radiator 51 through the radiator outlet hose is introduced into the cylinder body 40 through the cooling water introduction hose 92, thus cooling the respective portions. After returning to the radiator 51 through the thermostat 93 and the radiator inlet hose 95, the cooling water is repeatedly circulated in the cylinder body 40 through a similar route. In this case, if the cooling water passing through the thermostat 93 is at a fixed temperature or less, the cooling water is sent from the thermostat 93 through the bypass hose 94 to the water pump 88, thus being circulated without passing through the radiator 51. Meanwhile, if the cooling water passing through the thermostat 93 reaches the fixed temperature or more, the radiator fan 52 operates to forcibly cool the cooling water.

A water-cooled oil cooler (oil cooling device) 97 is attached on a front surface side of a front wall 96 of the lower case 58. This oil cooler 97 is arranged so as to be adjacent to a lower right side of the accommodation portion 86 of the secondary balancer 85, that is, slightly on a right side of the center portion of the crankcase 41 in the vehicle body width direction. The oil cooler 97 shares the use of the cooling water with the engine body 15. The cooling water for the oil cooler 97 is introduced from a branch pipe and a hose (not shown), which are in communication with the cooling water introduction hose 92, and is returned to the water pump 88 through a branch pipe and a hose (not shown), which are in communication with the radiator outlet hose 90.

Figure 5:
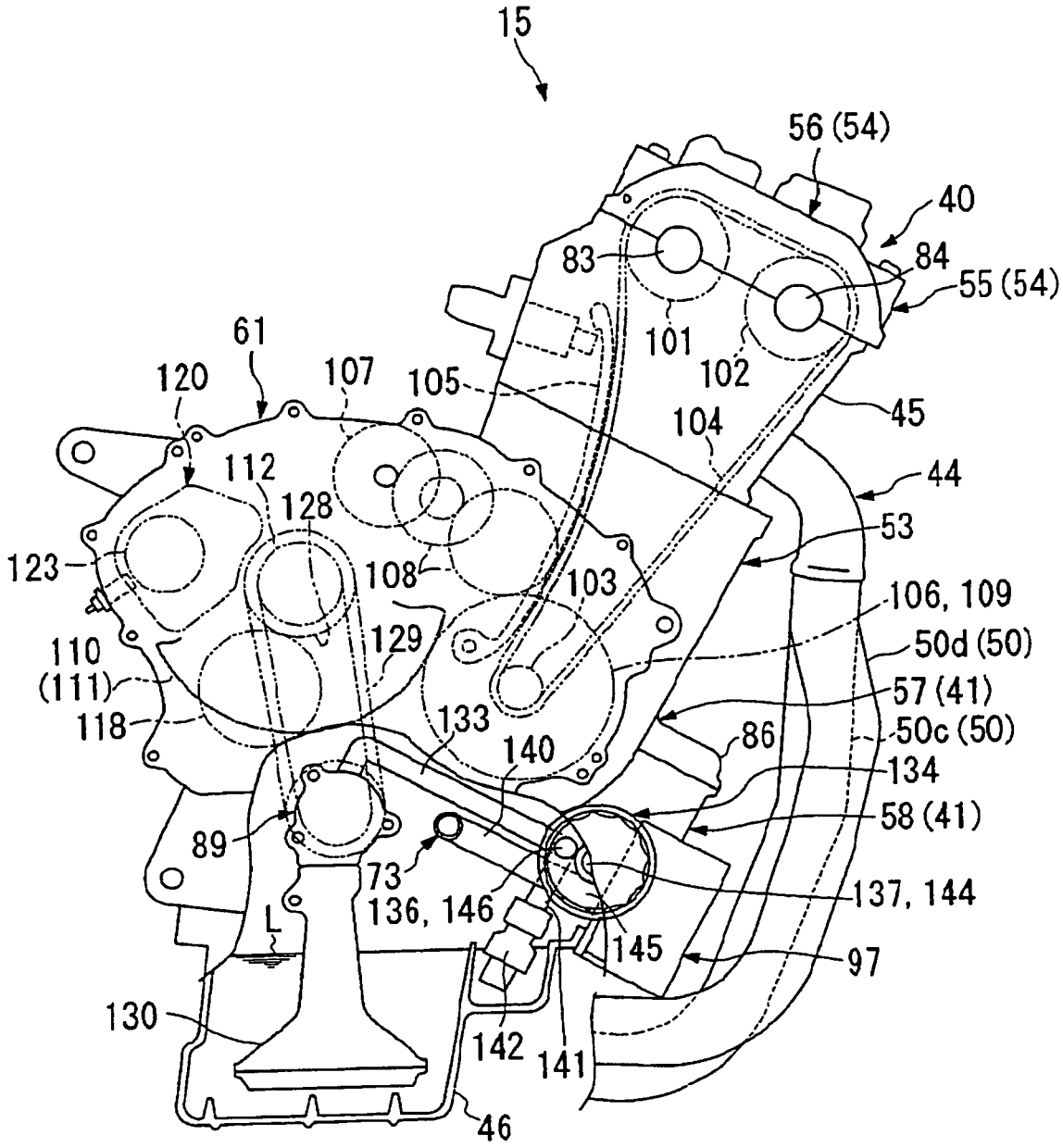
FIG. 5 is a side view of the engine body viewed from a right side.

As shown in FIG. 5, cam sprockets 101 and 102 are fixed to right side ends of the camshafts 83 and 84, respectively. A cam chain 104 is looped around these cam sprockets 101 and 102 and a chain sprocket 103 fixed to a right side end of the crankshaft 60, and the respective cam shafts 83 and 84 are rotated accompanied with the rotation of the crankshaft 60, thus operating the intake vales 81 and the exhaust valves 82 to open/close. A play of the cam chain 104 is controlled by a cam chain tensioner 105 of a single type.

Referring to FIG. 4 in combination, on the axial line C, a starter motor driven gear 106 is coupled to the right side end of the crankshaft 60 outside of the chain sprocket 103 in the vehicle body width direction, through an unillustrated one-way clutch. Moreover, a starter motor 107 is arranged in an upper portion of the transmission case 61. By this starter motor 107, the crankshaft 60 is rotationally driven only in a starting direction of the engine by interposing therebetween a starter gear group 108 meshing with a drive shaft of the starter motor 107.

A primary drive gear 109 is provided on outer peripheral portions of the left side crank arm 69 supporting the crank pin 68 on the most right side and of the counter weight 69*a* formed integrally with the crank arm 69. This primary drive gear 109 meshes with a primary driven gear 110 of a clutch mechanism 63 arranged on a right side of the transmission case 61. The clutch mechanism 63 includes the primary driven gear 110, a clutch outer 111 which rotates integrally therewith, a clutch center 113 which is accommodated in the clutch outer 111 and rotates integrally with a main shaft 112 of the transmission 62, and a plurality of friction plates 111*a* . . . , 113*a* . . . and the like on the clutch outer 111 side and the clutch center 113 side.

A pressure plate 115 energized by a plurality of clutch springs 114 is attached to a clutch center 113, and by this pressure plate 115, both of the friction plates 111*a* . . . , and 113*a* . . . are pressed relative to each other, and the clutch mechanism 63 comes into a state of being capable of transmitting power. Then, by an operation of the clutch lever 23, a clutch release 116 arranged on a left side of the transmission case 61 operates to move the pressure plate 115 by interposing therebetween a rod 117 inserted into the main shaft 112 while resisting an energizing force of the clutch spring 114. Thus, both of the friction plates 111*a* . . . , and 113*a* . . . are separated from each other, and a power transmission by the clutch mechanism 63 is cut.

The transmission 62 includes the main shaft 112 and a counter shaft 118 (both are spline shafts), which are arranged parallel to the axial line C and supported in the transmission case 61 so as to be freely rotatable, transmission gear groups 119 which are provided individually on both of these shafts 112 and 118 and engaged with each other by the splines thereof, and the like. The main shaft 112 is arranged coaxially with the clutch mechanism 63, and the clutch center 113 of the clutch mechanism 63 is fixed to a right end portion of the main shaft 112 in an engaging manner. Both of the main shaft 112 and the counter shaft 118 are hollow, the engine oil flows through such hollow portions, and the engine oil is supplied from oil holes and the like to the respective sliding surfaces, the transmission gear groups 119, the clutch mechanism 63 and the like.

The drive force of the engine body 15 is transmitted from the crankshaft 60 through the primary drive gear 109, the primary driven gear 110 and the clutch mechanism 63 to the main shaft 112 of the transmission 62. Moreover, the drive force is transmitted through the transmission gear groups 119 to the counter shaft 118 at a predetermined reduction ratio. Furthermore, the drive force is transmitted to the rear wheel 7 through the drive chain 34 from the drive sprocket 33 fixed to a left end portion of the counter shaft 118. 048 The reduction ratio of the transmission 62 undergoes a switching control by a change mechanism 120 arranged in a rear portion of the transmission case 61. The change mechanism 120 includes a ratchet portion 122 having a change spindle 121, a shift drum portion 123, a plurality of shift forks (one in the drawing) 125 attached onto a shift fork shaft 124 and engaged as appropriate with the shift drum portion 123 and the transmission gear groups 119 of the transmission 62, and the like. To an end portion of the change spindle 121, which protrudes from the transmission case 61, an unillustrated change pedal is coupled. By operating this change pedal, the change spindle 121 is rotated at a fixed angle, and the shift drum portion 123 is rotated accompanied therewith by interposing the ratchet portion 122 therebetween. Thus, the respective shift forks 125 change a meshing of the transmission gear groups 119 to change the reduction ratio.

Note that, individually, an AC generator including a rotor which rotates integrally with the crankshaft 60, a stator supported by a generator cover 126 and the like is provided on a left side end of the crankshaft 60, and an ignition timing detection mechanism including a pulser rotor which rotates integrally with the crankshaft, a pulse generator supported by a point cover 127 and the like is provided on the right side end of the crankshaft 60 (not shown in the drawings).

In the lower portion of the crank case 41, the oil pump 89 for sending the engine oil with pressure to appropriate regions in the engine body 15 is arranged. The oil pump 89 is linked with an oil pump drive sprocket 128, which is engaged with the main shaft 112 and rotates together with the primary driven gear 110, by interposing a chain 129 therebetween. The oil pump 89 starts to operate accompanied with the rotation of the crankshaft 60. Engine oil L is stored in the oil pan 46 fixed to the lower portion of the lower case 58. An oil strainer 130 is immersed in the stored engine oil L.

Figure 6:
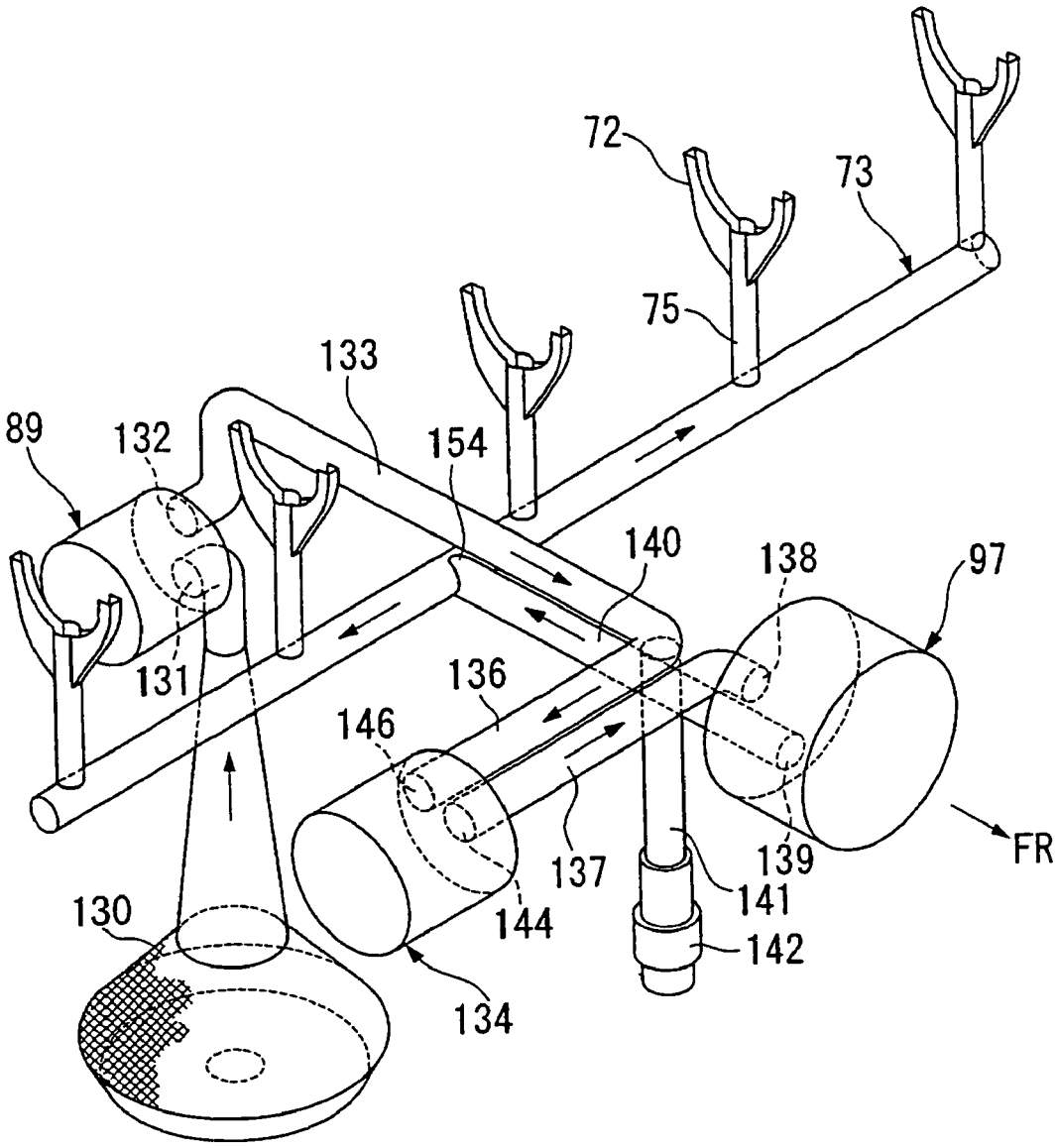
FIG. 6 is an explanatory perspective view of a lubrication passage for engine oil.

Referring to FIG. 6 in combination, an upper end portion of the oil strainer 130 is connected to a suction port 131 of the oil pump 89, and an outlet port 132 of the oil pump 89 is connected to a first oil passage 133 formed in the lower case 58. The first oil passage 133 is bent forward after extending upwardly from the outlet port 132 of the oil pump 89, and then extending forwardly while slightly descending forward. On a right side of the front wall 96 of the lower case 58, a holder portion 135 for attaching thereto a cartridge type oil filter 134 so as to be detachable in the vehicle body width direction is provided, and an oil inlet passage 136 extended from the holder portion 135 to the inside of the vehicle body width direction is provided. To a left side end of this oil inlet passage 136, a front end of the first oil passage 133 is connected. Moreover, an oil outlet passage 137 is provided in the front wall 96 of the lower case 58 in front of the oil inlet passage 136 approximately in parallel thereto. To a left side end of this oil outlet passage 137, an introduction port 138 of the oil cooler 97 is connected.

An extraction port 139 of the oil cooler 97 is connected to a second oil passage 140 formed in the lower case 58 and extending rearwardly approximately in parallel to the first oil passage 133 while slightly descending rearwardly. The second oil passage 140 is connected to oil galleries, oil jets and the like (not shown) in the engine body 15, the oil galleries including the main oil gallery 73. The engine oil aspirated from the oil strainer 130 by operating the oil pump 89 is sent with pressure to the first oil passage 133, filtered by the oil filter 134, and cooled by the oil cooler 97. Then, the engine oil is supplied into the engine body 15 from the second oil passage 140. In the main oil gallery 73, the engine oil introduced therein is supplied to the respective bearings 71 from the respective oil passages 74 and oil grooves 72. Note that, in FIG. 6, arrows in the respective passages indicate the flowing directions of the engine oil, and an arrow FR indicates the front of the vehicle body.

The engine oil supplied to the engine body 15 returns to an inside of the oil pan 46 due to a natural drop and the like, and then is stored. Then, the engine oil is repeatedly circulated in the engine body 15 through the above-described passages. In this circulation of the engine oil, oil pressure of the engine oil sent with pressure will be increased if the number of revolutions of the engine is increased for example. When this oil pressure reaches a predetermined value, an oil relief valve 142 connected to a lower side of an intersection portion of the first oil passage 133 and the oil inlet passage 136 by interposing a relief passage 141 therebetween is operated to return a part of the engine oil into the oil pan 46, thus adjusting the oil pressure in the passages.

The oil filter 134 is attached onto the holder portion 135 from a right end side of the engine body 15. The holder portion 135 is formed with the oil outlet passage 137 taken as an approximate center. A right side end surface of the holder portion 135 is formed to be approximately perpendicular to the vehicle body width direction, thus becoming an attachment surface 143 for the oil filter 134. An outlet opening portion 144 of the oil outlet passage 137 is provided on a center portion of this attachment surface 143, and a ring-shaped oil groove 145 is formed on a periphery of the outlet opening portion 144. On a bottom portion of this oil groove 145, an inlet opening portion 146 of the oil inlet passage 136 is provided.

Here, the oil filter 134 is an existing cartridge type filter, in which a filter element 148 is accommodated in a cylindrical case 147 having a bottom, and an opening of the case 147 is closed by a disc-shaped set plate 149. The filter element 148 is one formed by folding filter paper into a corrugated shape and forming the whole into a cylindrical shape. In this oil filter 134, the engine oil is passed from the outside of the filter element 148 to the inside thereof, and thus filtering is performed. A ring-shaped seal packing 150 is attached onto an inside of the opening of the case 147, thus making it possible to seal the oil filter 134 in a state of being attached onto the holder portion 135.

A circular hole 151 communicates with a space inside the filter element 148 and is formed on a center portion of the set plate 149. A female screw thread is formed on an inner peripheral portion of the circular hole 151. A nozzle 152 protruding from the attachment surface 143 in the vehicle body width direction is provided on the outlet opening portion 144 of the holder portion 135, and on an outer peripheral portion of this nozzle 152, a male screw thread corresponding to the female screw thread of the circular hole 151 is formed. Then, the circular hole 151 is screwed with the nozzle 152, the oil filter 134 is screwed onto the holder portion 135 while rotating itself. Thus, the oil filter 134 is attached onto the holder portion 135.

Then, in such a state where the oil filter 134 is attached onto the holder portion 135, the space inside the filter element 148 and the oil outlet passage 137 communicate with each other through the circular hole 151 and the nozzle 152. Here, on the periphery of the circular hole 151 of the set plate 149, a plurality of inlet holes 153 are formed which communicate with a space outside the filter element 148. These inlet holes 153 are arranged to be opposite to the oil groove 145 of the attachment surface 143 in the attachment state of the oil filter 134. The oil inlet passage 136 and the space outside the filter element 148 communicate with each other through the oil groove 145 and the inlet hole 153.

In such a way, the engine oil sent from the first oil passage 133 to the oil inlet passage 136 flows into the oil filter 134 through the oil groove 145 and the inlet hole 153, passes from the space outside the filter element 148 to the space inside the filter element 148, and is filtered. Then, the filtered engine oil is sent to the oil outlet passage 137 through the circular hole 151 and the nozzle 152, and introduced into the oil cooler 97.

The oil cooler 97 has a cylindrical appearance, and one end surface side thereof is fixed to the front wall 96 of the lower case 58. The engine oil sent to the oil cooler 97 is introduced from the introduction port 138 into the oil cooler 97, and cooled while passing through a predetermined passage. Then, the engine oil extracted from the extraction port 139 to the second oil passage 140 is supplied from the oil galleries, the oil jets and the like to the respective portions of the engine body 15. The engine oil supplied into the engine body 15 lubricates the crankshaft 60, the transmission 62, the clutch mechanism 63, the pistons 65, the respective camshafts 83 and 84 and the like, and operates for shock absorption, hermetical sealing, cooling and the like for the engine body 15.

The oil cooler 97 is arranged in the vicinity of the center portion (slightly on the right side) of the crankcase 41 in the vehicle body width direction, and the second oil passage 140 is also arranged in the approximate center of the crank case 41 in the vehicle body width direction. The center portions of the crankcase 41, crankshaft 60 and main oil gallery 73 in the vehicle body width direction are proximate to one another, and the second oil passage 40 extending rearwardly from the oil cooler 97 is connected to a connection portion 154 on an approximate center of the main oil gallery 73 in the vehicle body width direction. Therefore, oil pressure of the engine oil introduced into the main oil gallery 73 is made substantially uniform, and the engine oil is distributed uniformly in the vehicle body width direction.

Here, as shown in FIG. 3 and FIG. 4, the downward extending portion 50 of each of the respective exhaust pipes 44 is somewhat bent forward so as to form an approximate V shape that is convex in the vicinity of a center thereof in the vertical direction in terms of its layout with the radiator 51 arranged in front of the downward extended portion 50, and with the oil cooler 97, the secondary balancer 85, the oil filter 134 and the like, which are provided on the crankcase 41 side. Moreover, the downwardly extending portions 50*a* and 50*d* of the exhaust pipes 44*a* and 44*d* on the far left side and the far right side are bent in a crank shape such that lower portions thereof are bent more forward than upper portions thereof.

Then, the downwardly extending portion 50*d* of the exhaust pipe 44*d* on the far right side is bent such that the lower portion thereof is changed more inwardly in the vehicle body width direction than the upper portion thereof. Thus, the downwardly extending portion 50*d* of the exhaust pipe 44*d* and the oil filter 134 are arranged so as not to overlap each other when viewed from the front of the engine body 15 (refer to FIG. 2). Specifically, the downwardly extending portion 50*d* of the exhaust pipe 44*d* on the far right side extends inwardly in the vehicle body width direction so as not to overlap the oil filter 134 in a front and back direction.

Figure 7:
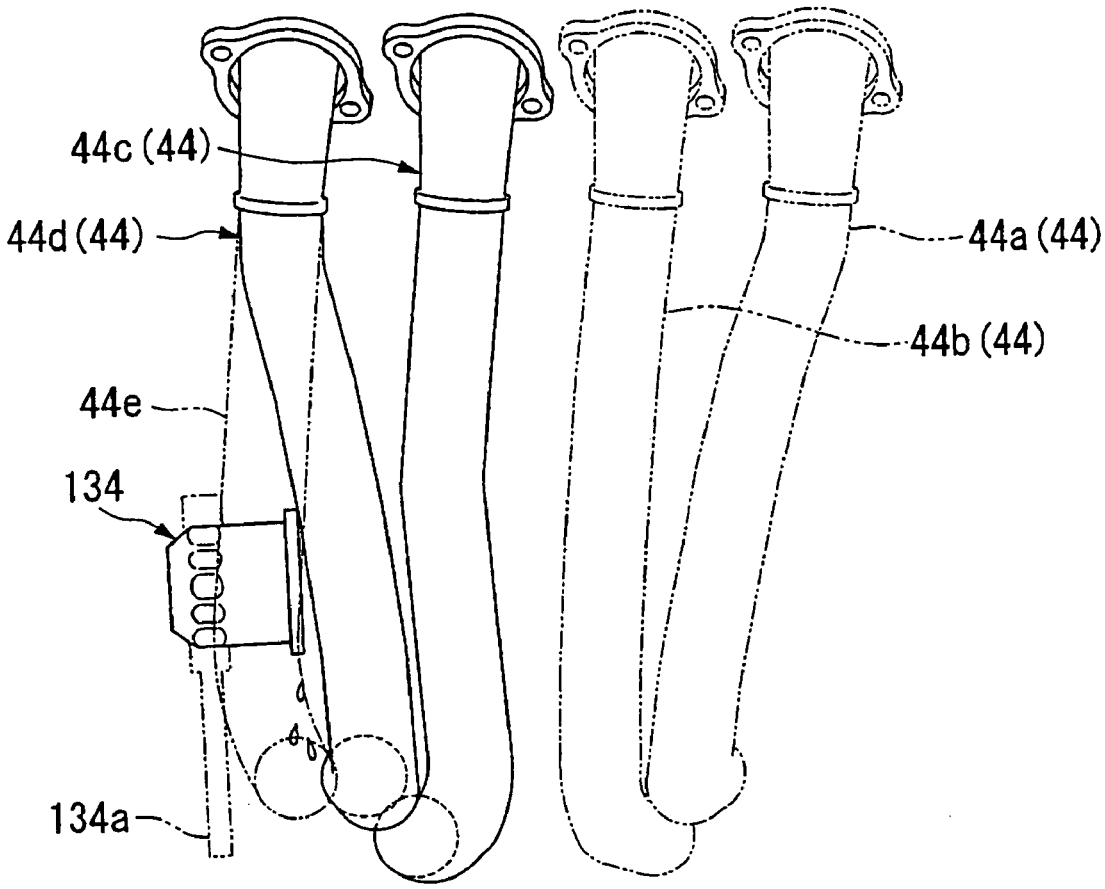
FIG. 7 is an explanatory front view showing a state where a tool for attaching/detaching an oil filter is positioned on the oil filter.

Hence, as shown in FIG. 7, a tool 134*a* for attaching/detaching the oil filter 134 can be used without interfering with the exhaust pipe 44*d*. Similarly, it is easy to hold the oil filter 134 by hand. Moreover, the downwardly extending portion 50*d* of the exhaust pipe 44*d* extends rearwardly below the crankcase 41 after extending around the oil filter 134. Accordingly, unlike an exhaust pipe 44*e* illustrated in broken lines, the exhaust pipe 44*d* is not arranged immediately below the oil filter 134, and the exhaust pipe is not soiled by engine oil dropping when the oil filter 134 is attached/detached.

According to the above-described embodiment, in the vehicle engine including the exhaust pipes 44 which are curved downwardly after extending forwardly from the front wall 45 of the cylinder body 40, pass in front of and below the crankcase 41, and extend rearwardly of the engine body 15, the oil filter 134 is attached onto the front portion of the engine body 15 so as to be detachable from the side end side of the engine body 15 in the vehicle body width direction, thus making it possible to enhance an ease of maintenance because there are no obstructions in the direction of attaching/detaching the oil filter 134.

Moreover, in a case where the radiator 51 arranged in front of the engine body 15 extends downwardly to increase the capacity thereof, if a configuration in which the oil filter 134 is attached/detached in the front and back direction of the vehicle body is adopted, usually, it is necessary to increase a gap between the radiator 51 and the engine body 15, and so on. Meanwhile, if the configuration in which the oil filter 134 is attached/detached in the vehicle body width direction is adopted, even if the radiator 51 extends to the lower portion of the crankcase 41, this will not inhibit the oil filter 134 from being attached/detached. Accordingly, a length of the engine in the front and back directions can be restrained, and an overall length of the vehicle body can be restrained.

Furthermore, the downwardly extending portion 50*d* of the exhaust pipe 44*d* on the far right side is displaced to the vehicle body width direction so as not to overlap, in the front and back direction of the vehicle body, the oil filter 134 provided on the right side of the front wall 96 of the lower case 58. Accordingly, the tool and the hand do not interfere with the exhaust pipe when the oil filter 134 is attached/detached in the vehicle body width direction, and the engine oil dropping when the oil filter 134 is attached/detached does not soil the exhaust pipe 44*d*. Thus, the attachment/detachment work of the oil filter 134 is facilitated making it possible to enhance the ease of maintenance.

Furthermore, when the vehicle is maintained in the erected state being inclined to the left side by the side stand 27, the attachment surface 143 of the holder portion 135 faces upward. Accordingly, it is easy to attach/detach the oil filter 134, and the engine oil can be restrained from dropping from the holder portion 135, thus making it possible to further enhance the ease of maintenance.

At this time, the exhaust pipe 44*d* on the far right side is changed to the center side in the vehicle body width direction together with the exhaust pipe 44*a* on the far left side. Accordingly, an outer dimension of the engine including the exhaust pipes 44 is restrained, leading to no lowering of a degree of freedom in the vehicle body layout. Moreover, the downwardly extending portions 50 of the exhaust pipes 44 are bent, thus making it possible to achieve an equalization of the lengths of the exhaust pipes of the respective cylinders while extending the exhaust pipe lengths, and to enhance a degree of freedom in setting output characteristics of the engine.

Moreover, the engine oil sent with pressure from the oil pump 89 is sent from the oil filter 134 to the oil cooler 97 arranged in the vicinity of the center portion of the crankcase 41 in the vehicle body width direction, and then introduced into the approximate center portion of the main oil gallery 73 in the vehicle body width direction. Accordingly, the oil pressure of the engine oil introduced into the main oil gallery 73 is made substantially uniform in the vehicle body width direction, and the engine oil can be supplied evenly in the engine body 15 in the vehicle body width direction.

Furthermore, the oil cooler 97 is provided on the front portion of the engine body 15, and accordingly, an air-cooling effect of air passing over the engine oil filter is high. Moreover, the engine oil is filtered through the oil filter 134, cooled in the oil cooler 97, and then supplied into the engine body 15. Accordingly, the action of lubrication, cleaning and cooling for the respective portions in the engine body 15 can be enhanced.

Note that the present invention is not limited to the above-described embodiment, and for example, the engine does not have to be of an in-line four-cylinder type as long as it has a plurality of cylinders arrayed in the vehicle body width direction. Moreover, a configuration may also be made such that the oil filter 134 is provided on the left side of the crankcase 41 and that the oil filter 134 is attached/detached to/from the left side end of the engine body 15. Furthermore, the oil cooler 97 may be an air-cooled one. In addition, this invention can also be applied to three-wheel and four-wheel vehicles without being limited to a motorcycle.

As described above, according to the present invention, the exhaust pipe on the side on which the oil filter is attached is changed to the center side in the vehicle body width direction so as not to overlap the oil filter when viewed from the front of the engine body. Thus, it is facilitated for the oil filter to be attached/detached in the vehicle body width direction. Accordingly, it is possible to enhance the ease of maintenance. Moreover, the exhaust pipe is changed to the center side in the vehicle body width direction. Thus, the outer dimension of the engine can be restrained. Accordingly, the degree of freedom in vehicle body layout is not lowered.

According to the present invention, the oil cooling device is provided on the front portion of the engine body. Thus, the air-cooling effect of air passing over the engine oil filter is enhanced, and even if the oil-cooling device is of a water-cooled type, cooling performance thereof can be enhanced. Moreover, the engine oil is introduced from the oil cooling device into the approximate central portion of the main oil gallery in the vehicle body width direction. Accordingly, the oil pressure in the main oil gallery is made uniform, and the engine oil can be supplied evenly in the vehicle body width direction. Furthermore, the engine oil is supplied into the engine body after passing through the oil filter and the oil cooling device, thus making it possible to enhance the cooling action for the respective portions in addition to the lubrication and cleaning actions therefor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vehicle engine including a plurality of exhaust pipes which are curved downwardly from a front wall of a cylinder body, pass in front of and below a crankcase, and extend rearwardly of an engine body, in which an oil filter is attached onto a front portion of the engine body to be detachable in a vehicle body width direction from a side face of the engine body comprising:

the exhaust pipe on a side on which the oil filter is attached is displaced to a central portion in the vehicle body width direction so as not to overlap the oil filter when viewed from a front of the engine body.

2. The vehicle engine according to claim 1, wherein an oil cooling device is provided on the front portion of the engine body, engine oil having passed through the oil filter is introduced into the oil cooling device, and the engine oil having passed through the oil cooling device is introduced into an approximate center portion of a main oil gallery in the vehicle body width direction, the main oil gallery being arranged in the crankcase across vicinities of both ends of a crankshaft.

3. The vehicle engine according to claim 1, wherein the oil filter is unobstructed to readily permit at least one of an attachment and detachment of the oil filter from the engine body.

4. The vehicle engine according to claim 1, wherein the plurality of downwardly extending exhaust pipes are bent forward to form an approximate V shape that is convex in the vicinity of a center thereof.

5. The vehicle engine according to claim 4, wherein the downwardly extending portions of the exhaust pipes on a far left side and a far right side are bent in a crank shape wherein lower portions thereof are bent more forward than upper portions thereof.

6. The vehicle engine according to claim 5, wherein the downwardly extending portion of the exhaust pipe on the far right side is bent wherein the lower portion thereof is moved inwardly with respect to the vehicle body.

7. The vehicle engine according to claim 5, wherein the downwardly extending portion of the exhaust pipe on the far left side is bent wherein the lower portion thereof is moved inwardly with respect to the vehicle body.

8. The vehicle engine according to claim 1, wherein the exhaust pipe on the side on which the oil filter is attached does not overlap the oil filter in a front and back direction relative to the vehicle body.

9. The vehicle engine according to claim 1, wherein the exhaust pipe on the side on which the oil filter is attached does not interfere with the attachment/detachment of the oil filter.

10. An opening for attaching an oil filter on a vehicle engine comprising:

a plurality of exhaust pipes curved downwardly from a front wall of the vehicle engine and passing in front of and below a crankcase and extending rearwardly of an vehicle engine;

an opening for attaching an oil filter, said opening being disposed on a side portion of the vehicle engine;

an exhaust pipe on a side of the opening for attaching the oil filter is displaced to a central portion relative to the vehicle engine so as not to overlap the oil filter when viewed from a front of the vehicle engine.

11. The opening for attaching an oil filter on a vehicle engine according to claim 10, wherein an oil cooling device is provided on the front portion of the vehicle engine, engine oil having passed through the oil filter is introduced into the oil cooling device, and the engine oil having passed through the oil cooling device is introduced into an approximate center portion of a main oil gallery in the vehicle engine width direction, the main oil gallery being arranged in the crankcase across vicinities of both ends of a crankshaft.

12. The opening for attaching an oil filter on a vehicle engine according to claim 10, wherein the oil filter is unobstructed to readily permit at least one of an attachment and detachment of the oil filter from the vehicle engine.

13. The opening for attaching an oil filter on a vehicle engine according to claim 10, wherein the plurality of downwardly extending exhaust pipes are bent forward to form an approximate V shape that is convex in the vicinity of a center thereof.

14. The opening for attaching an oil filter on a vehicle engine according to claim 13, wherein the downwardly extending portions of the exhaust pipes on a far left side and a far right side are bent in a crank shape wherein lower portions thereof are bent more forward than upper portions thereof.

15. The opening for attaching an oil filter on a vehicle engine according to claim 14, wherein the downwardly extending portion of the exhaust pipe on the far right side is bent wherein the lower portion thereof is moved inwardly with respect to the vehicle engine.

16. The opening for attaching an oil filter on a vehicle engine according to claim 14, wherein the downwardly extending portion of the exhaust pipe on the far left side is bent wherein the lower portion thereof is moved inwardly with respect to the vehicle engine.

17. The opening for attaching an oil filter on a vehicle engine according to claim 10, wherein the exhaust pipe on the side on which the oil filter is attached does not overlap the oil filter in a front and back direction relative to the vehicle engine.

18. The opening for attaching an oil filter on a vehicle engine according to claim 10, wherein the exhaust pipe on the side on which the oil filter is attached does not interfere with at least one of the attachment and detachment of the oil filter.

* * * * *